US006967295B2

(12) United States Patent
Ting

(10) Patent No.: US 6,967,295 B2
(45) Date of Patent: Nov. 22, 2005

(54) CONNECTING STRUCTURE BETWEEN A LIQUIDIZER SWITCH AND A CIRCUIT BOARD

(76) Inventor: Lee Chun Ting, No. 7, Alley 14, Lane 101, Syuefu Rd., Daya Township, Taichung County (TW)

( * ) Notice: Subject to any disclaimer, the term of this patent is extended or adjusted under 35 U.S.C. 154(b) by 30 days.

(21) Appl. No.: 10/781,546

(22) Filed: Feb. 17, 2004

(65) Prior Publication Data

US 2005/0178645 A1 Aug. 18, 2005

(51) Int. Cl.[7] ..... H01R 24/00

(52) U.S. Cl. ..... 200/51 R; 200/51.05; 200/51.06; 200/51.11; 200/292

(58) Field of Search ..... 200/51 R–51.12, 200/292, 295–297, 307; 174/260; 439/79–82, 439/571, 572

(56) References Cited

U.S. PATENT DOCUMENTS

| | | | | |
|---|---|---|---|---|
| 4,095,074 | A * | 6/1978 | Lockard | 200/295 |
| 4,242,544 | A * | 12/1980 | Schweitzer | 200/5 E |
| 4,707,765 | A * | 11/1987 | Ohashi | 361/761 |
| 4,997,996 | A * | 3/1991 | Ohashi | 174/260 |
| 5,550,340 | A * | 8/1996 | Ogawa | 200/295 |
| 5,587,568 | A * | 12/1996 | Lothamer et al. | 200/16 R |
| 6,489,580 | B2 * | 12/2002 | Yanai et al. | 200/406 |
| 6,790,047 | B2 * | 9/2004 | Togashi | 439/63 |

* cited by examiner

*Primary Examiner*—Michael A. Friedhofer
(74) *Attorney, Agent, or Firm*—Charles E. Baxley

(57) ABSTRACT

A connecting structure between a liquidizer switch and a circuit board comprises a liquidizer switch and a circuit. The liquidizer switch has a coupling end and the coupling end is defined with a slot. Plural conducting strips are arranged in the slot. The circuit board has a conducting end that is inserted into the slot of the liquidizer switch and contacts with the conducting strips. Thus, welding is not necessary at all, so as to save labor and improve assembly efficiency. On the other hand, the present structure can prevent the circuit board from being damaged because of high temperature produced during welding.

2 Claims, 6 Drawing Sheets

CONNECTING STRUCTURE BETWEEN A LIQUIDIZER SWITCH AND A CIRCUIT BOARD

BACKGROUND OF THE INVENTION

1. Field of the Invention

The present invention relates to a connecting structure, and more particularly to a connecting structure between a liquidizer switch and a circuit board.

2. Description of the Prior Arts

With reference to FIG. 1, between a conventional liquidizer switch 10 and a circuit board 11 is provided with conducting wire 12, and they are connecting with each other by welding method, however, there are still some defects may be caused during assembly and need to be improved as follows:

First, the liquidizer switch 10, the circuit board 11 and the conducting wire 12 are connected with each other by manual welding, thereby, it is not only inconvenient for assembly, but also the cost will be pretty high.

Second, the liquidizer switch 10, the circuit board 11 and the conducting wire 12 are connected with each other by manual welding, too high temperature will probably damage the circuit board 11 in case of improper welding, the NG products are accordingly increased; Or too low temperature will produce spaces in the welding portion, such that the conductance is badly affected.

The present invention has arisen to mitigate and/or obviate the afore-described disadvantages of the conventional connecting structure between a liquidizer switch and a circuit board.

SUMMARY OF THE INVENTION

The primary object of the present invention is to provide a connecting structure between a liquidizer switch and a circuit board, wherein the liquidizer switch can be directly connected to the circuit board through the connecting structure, thus welding process can be omitted, so as to save labor and improve assembly efficiency.

The secondary object of the present invention is to provide a connecting structure between a liquidizer switch and a circuit board, wherein the liquidizer switch can be directly connected to the circuit board through the connecting structure, thus welding process can be omitted, so as to reduce the defective rate.

The connecting structure in accordance with the present invention includes:

- a liquidizer switch having a coupling end, on the coupling end is defined with a slot, and in which provided with a plurality of conducting strips;
- a circuit board having a conducting end adapted for direct insertion into the slot of the liquidizer switch and contacting with the conducting strips.

The present invention will become more obvious from the following description when taken in connection with the accompanying drawings, which shows, for purpose of illustrations only, the preferred embodiments in accordance with the present invention.

DETAILED DESCRIPTION OF THE PREFERRED EMBODIMENTS

Figure 1:
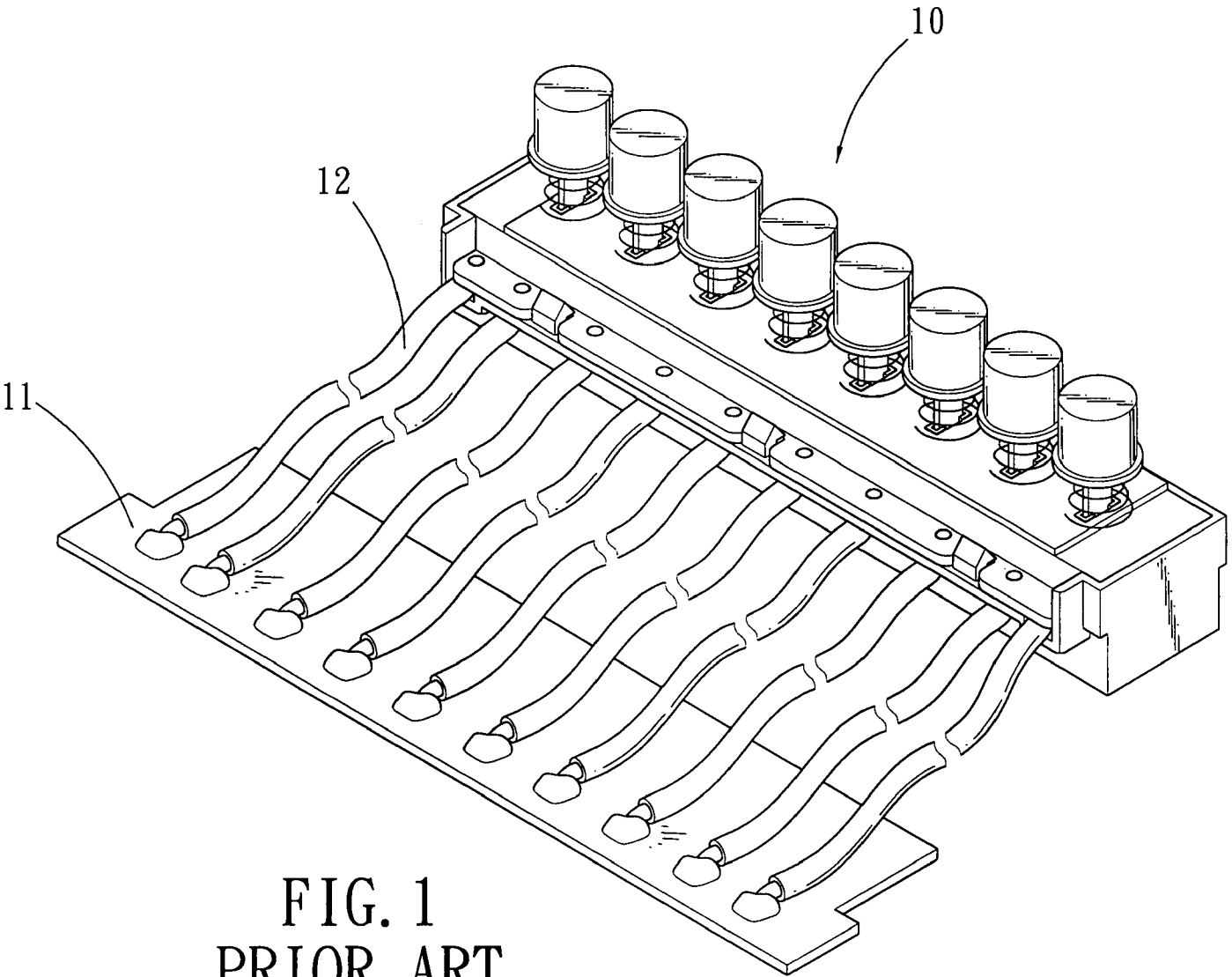
FIG. 1 PRIOR ART
FIG. 1 is a perspective view of conventional connecting structure between liquidizer switch and circuit board.
Figure 2:
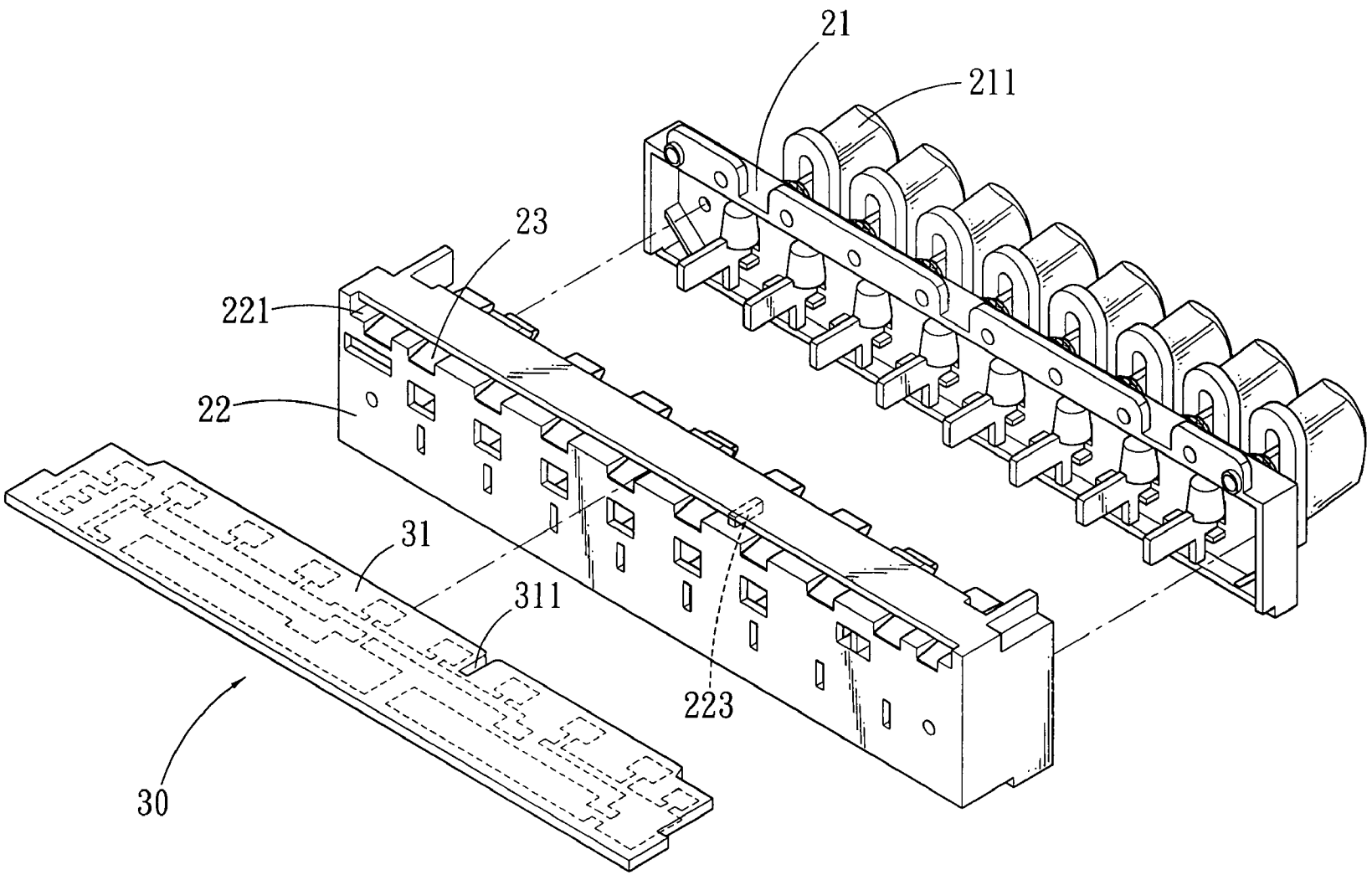
FIG. 2 is an exploded view of a connecting structure between liquidizer switch and circuit board in accordance with a first embodiment of the present invention.
Figure 3:
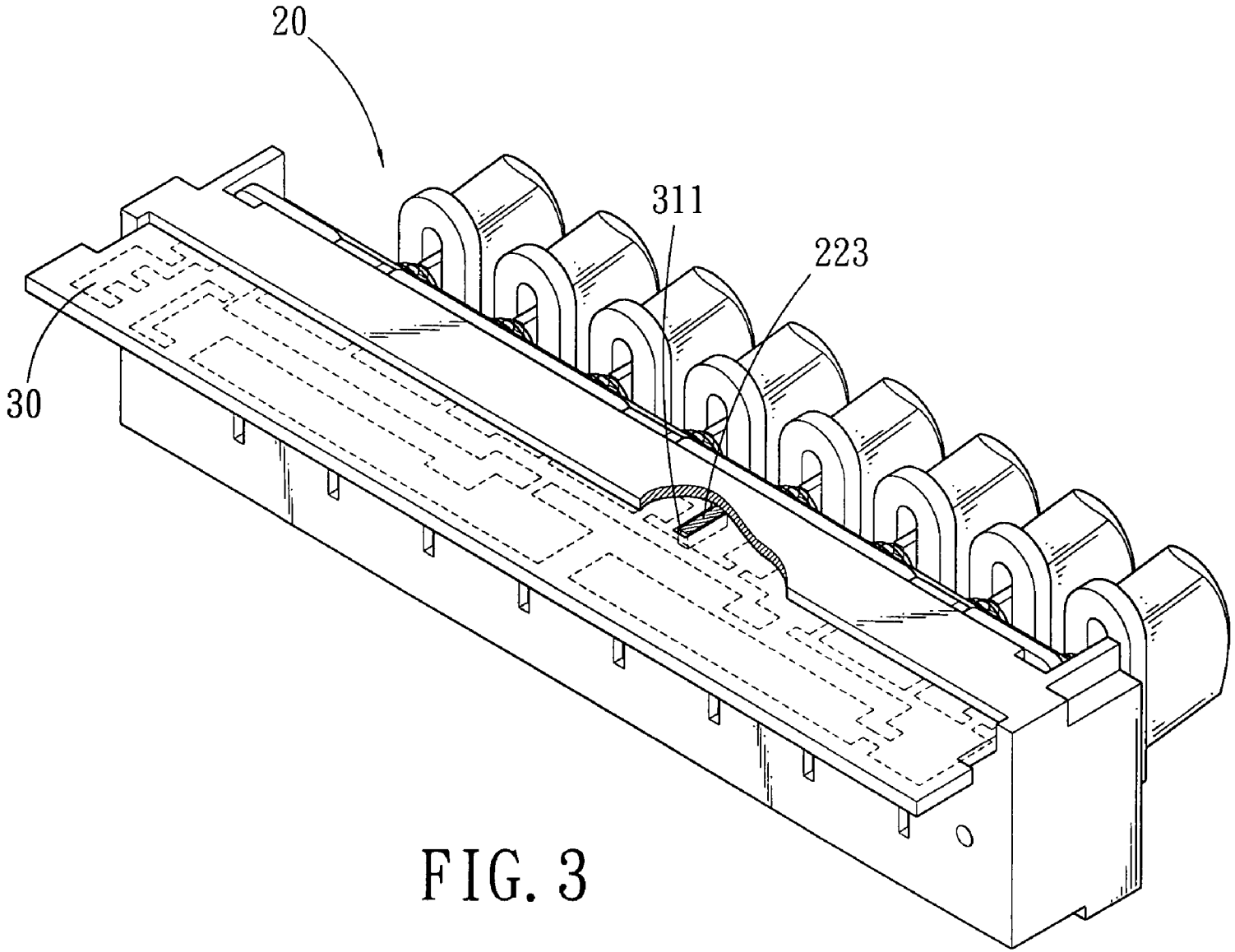
FIG. 3 is an assembly view of a connecting structure between liquidizer switch and circuit board in accordance with a first embodiment of the present invention.
Figure 4:
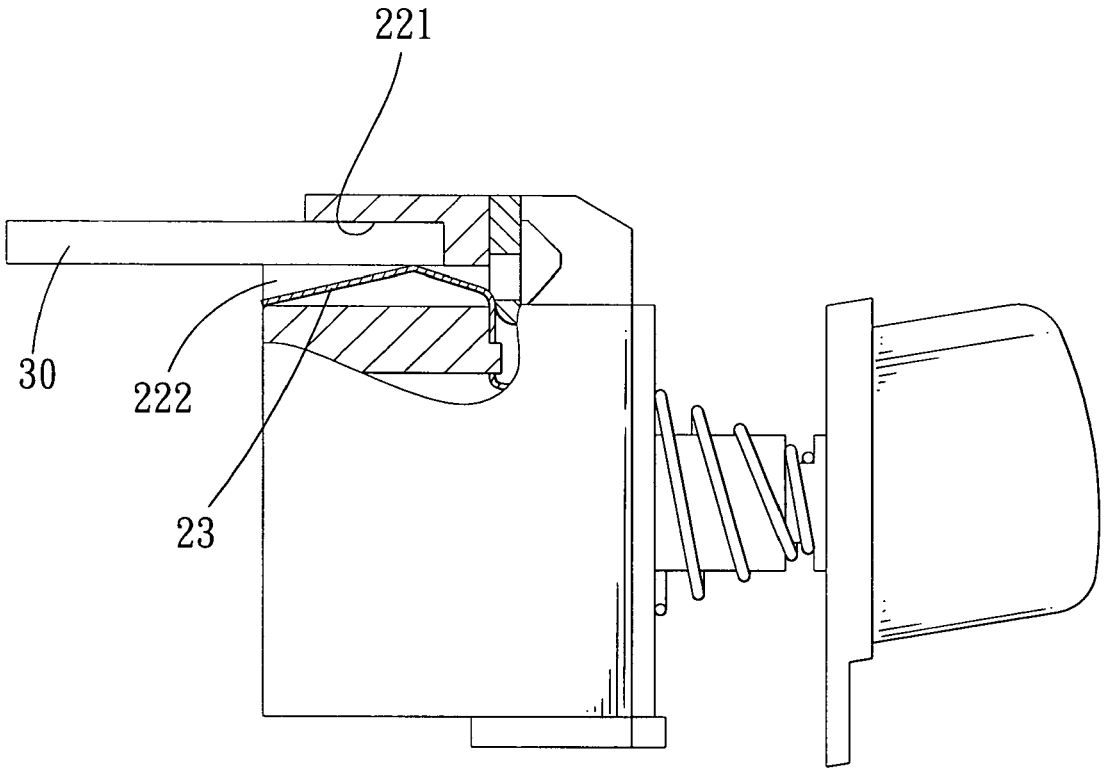
FIG. 4 is a partial cross sectional view of the connecting structure between liquidizer switch and circuit board in accordance with a first embodiment of the present invention.

Referring to FIGS. 2–4, wherein a connecting structure between a liquidizer switch and a circuit board in accordance with a first embodiment of the present invention is shown and generally comprised of a liquidizer switch 20 and a circuit board 30.

The liquidizer switch 20 has an upper base 21 engaged with a lower base 22. Wherein the upper base 21 is provided with plural buttons 211, whereas the lower base 22 is provided with a coupling end. The coupling end is defined with a slot 221, and on an internal surface of the slot 221 is defined with plural recesses 222 and a conducting leg 223, wherein the conducting leg 223 is located in a non-central position along the long side of the slot 221. In a space, that is formed after the upper base 21 and the lower base 22 engaged with each other, is provided with plural conducting strips 23 each having an end inserted in the respective recesses 222 of the slot 221.

The circuit board 30 has a conducting end 31, in a non-central position on the conducting end 31 is formed with a notch 311 for insertion of the conducting leg 223. The conducting end 31 is directly inserted in the slot 221 of the liquidizer switch 20, and an end surface of the conducting end 31 contacts the conducting strips 23.

In assembly, the user only needs to align the conducting end 31 of the circuit board 30 to the slot 221 of the liquidizer switch 20, and then assembly can be achieved just by inserting the circuit board 30 in the slot 221 of the liquidizer switch 20. Thus, welding can be omitted so as to save labor and improve assembly efficiency. On the other hand, the present structure can prevent the circuit board from being damaged because of high temperature produced during welding.

Besides, the conducting leg 223 of the liquidizer switch 20 can enable the quick insertion of the circuit board 30 into the slot 221.

Figure 5:
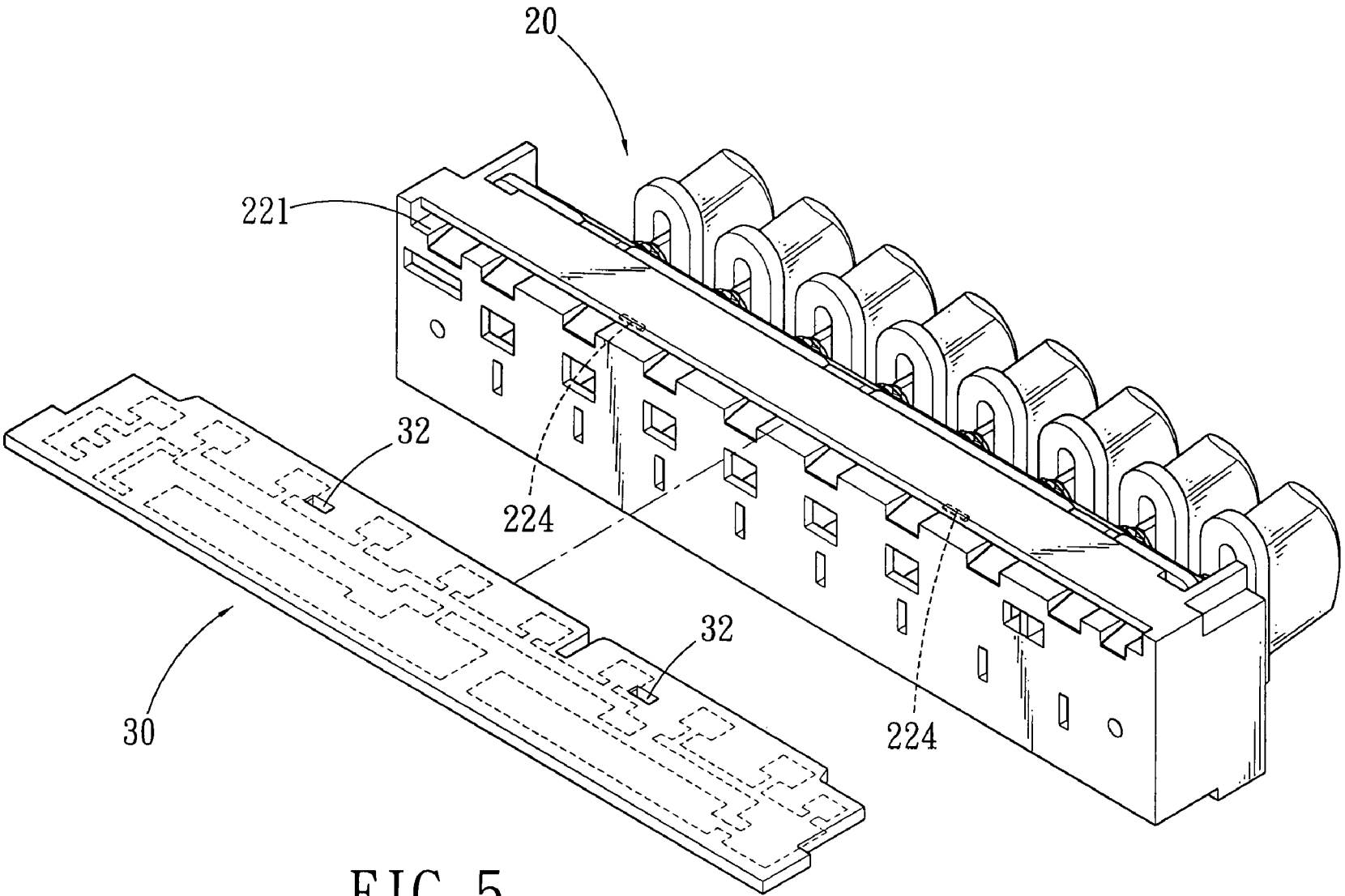
FIG. 5 is an exploded view of a connecting structure between liquidizer switch and circuit board in accordance with a second embodiment of the present invention.
Figure 6:
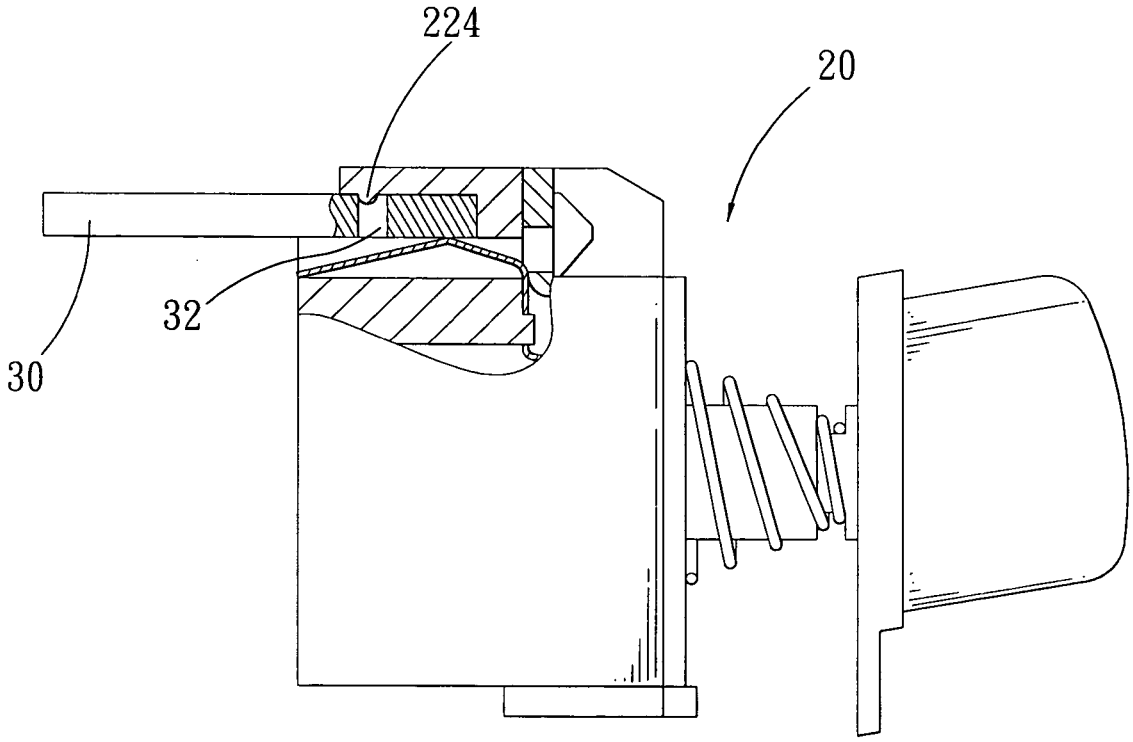
FIG. 6 is a partial cross sectional view of the connecting structure between liquidizer switch and circuit board in accordance with the second embodiment of the present invention.

Referring further to FIGS. 5 and 6, wherein a connecting structure between a liquidizer switch and a circuit board in accordance with a second embodiment of the present invention is shown and also comprised of a liquidizer switch 20 and a circuit board 30. However, the differences of this embodiment from the first embodiment are explained as follows:

On an internal surface of the slot 221 of the liquidizer switch 20 is formed with two ribs 224, whereas on the circuit board 30 is correspondingly defined with locating holes 32 for insertion of the ribs 224. The ribs 224 can be engaged in the locating holes 32 of the circuit board 30 during the insertion of the circuit board 30 into the slot 221 of the liquidizer switch 20, such that the circuit board 30 can be more firmly engaged with the liquidizer switch 20.

While we have shown and described various embodiments in accordance with the present invention, it should be clear to those skilled in the art that further embodiments may be made without departing from the scope of the present invention.

What is claimed is:

1. A connecting structure between a liquidizer switch and a circuit board, comprising:

a liquidizer switch having a coupling end, on the coupling end defined with a slot, and in the slot provided with a conducting leg and a plurality of conducting strips, the conducting leg of the liquidizer switch located in a non-central position along the long side of the slot;

a circuit board having a conducting end, on the conducting end formed with a notch for insertion of the conducting leg, the conducting end adapted for direct insertion into the slot of the liquidizer switch and contacting with the conducting strips.

2. The connecting structure between a liquidizer switch and a circuit board as claimed in claim 1, wherein at least a rib is formed on an internal surface of the slot of the liquidizer switch, whereas on the circuit board is correspondingly defined with locating hole for insertion of the rib.

* * * * *